US006101838A

United States Patent [19]

Teague

[11] Patent Number: 6,101,838

[45] Date of Patent: Aug. 15, 2000

[54] BEVERAGE CHILLER AND HOLDER

[76] Inventor: Linda Teague, 6502 Diamond Ct., Amarillo, Tex. 79124

[21] Appl. No.: 09/187,154

[22] Filed: Nov. 6, 1998

[51] Int. Cl.[7] ..... F25D 3/08

[52] U.S. Cl. ..... 62/457.4; 62/371; 62/530

[58] Field of Search ..... 62/457.3, 457.4, 62/530, 371, 372

[56] References Cited

U.S. PATENT DOCUMENTS

| | | | |
|---|---|---|---|
| 3,840,153 | 10/1974 | Devlin . | |
| 4,232,532 | 11/1980 | Marsh | 62/457.4 |
| 4,961,324 | 10/1990 | Allan | 62/400 |
| 5,201,194 | 4/1993 | Flynn, Jr. et al. | 62/457.3 |
| 5,212,963 | 5/1993 | McGinnis | 62/457.4 |
| 5,573,141 | 11/1996 | Chen | 62/457.3 |
| 5,653,124 | 8/1997 | Weber | 62/457.4 |

*Primary Examiner*—Henry Bennett
*Assistant Examiner*—Melvin Jones
*Attorney, Agent, or Firm*—Royston, Rayzor, Vickery, Novak & Druce, L.L.P.

[57] ABSTRACT

A beverage retainer and method of use in which a beverage container has two chambers which are fluidly separate from each other and are positioned next to each other for thermal conductivity. One chamber has a resealable closing member adapted to contain a chilling material. The resealable closing member is removed and chilling material, such as ice, is dispensed therein. The closing member is then secured so that the deposited ice is thereafter retained within the second chamber until removed. Preferably, the releasable closing member is mated with threads to the second chamber. The beverage container may also include a lid adapted to contain liquid within the first chamber. Preferably, this lid contains an aperture from which fluid is withdrawn. Further, the lid may include an aperture in which a straw is insertable. A handle assembly is attached to the two chambers to permit a user to conveniently hold the beverage container.

15 Claims, 2 Drawing Sheets

BEVERAGE CHILLER AND HOLDER

DESCRIPTION

1. Technical Field

The present invention relates generally to beverage containers and more specifically to individual beverage containers having a chilling capacity.

2. Background Art

Many beverages are intended to be chilled when served and therefore several different types of products have been developed and are sold for this purpose. Such known devices include those having a capability for chilling a beverage by refrigerating it or otherwise cooling the beverage through a container such as a can or bottle in a refrigerator or ice chest. Shortly after removing the beverage from a refrigerated area, however, the beverage begins to warm. This is the case unless some source of cooling is maintained with the beverage container, even where insulation is provided in the container's construction. One attempt to solve this problem is to introduce ice into the beverage. This method is often utilized because ice is readily available, usually inexpensive, and easily dispensed for these purposes. A well known drawback of this method is that the ice begins to melt almost immediately due to the warming process and detrimentally dilutes the beverage. In an effort to alleviate this drawback, certain beverage containers are constructed with interior portions filled with fluids, gels or other material that readily freezes and does not come in contact with the beverage for cooling. Such apparatus are expensive and can not readily be sold with a single serving beverage at point-of-sale facilities such as convenience stores or sporting events.

In view of the above described deficiencies associated with these known designs for beverage containers and the methods employed for maintaining the chill in a single serving beverage, the present invention has been developed to alleviate these drawbacks and provide further benefits to the user. These enhancements and benefits are described in greater detail hereinbelow with respect to several alternative embodiments of the present invention.

DISCLOSURE OF THE INVENTION

The present invention in its several disclosed embodiments alleviates the drawbacks described above with respect to conventionally designed beverage containers and their methods of use. The beverage container described herein is capable of keeping a canned, bottled, or otherwise separately contained liquid beverage cold. Further, the invention performs the typical beverage chilling and holding functions, but does not require prechilling of either the holder or the beverage to produce a chilled beverage. The container has the capacity for maintaining or reducing the temperature of a beverage dispensed directly into an appropriately configured container, such as from a fountain, by the filling of an adjacent, but separate chamber with a chilling material such as ice. The material used to divide the chambers is selected to be thermally conductive so that the chilling effect from the one chamber is easily transferred to the other where the beverage is contained.

The present invention also embodies features which provide a more sanitary drinking device for the public, especially in point-of-use sales. It is intended that the present invention be utilized in many alternative environments, but popular environments will be fast food restaurants and convenience stores. In such settings, it is not unusual for ice to be exposed to the public prior to dispensation for beverage cooling. In almost all cases, the cooling ice is deposited directly into the beverage so that any contamination contained therein is also introduced into the beverage and ultimately drank by the consumer. By isolating the ice from the beverage, such contamination is prevented.

The present invention is a beverage retainer comprising two chambers wherein a first chamber is fluidly separate from a second chamber and the first chamber and the second chamber are positioned proximate to each other for thermal conductivity there between. A releasable closing member is adapted to contain a chilling material such as ice within the second chamber. The beverage retainer optionally further comprises a handle projecting outward from an outermost wall of the two chambers.

In one embodiment, the first chamber is defined by an inner tubular portion and a bottom wall portion joined to a lower edge of the inner wall portion. The second chamber is defined by an outer tubular wall portion spaced from the inner tubular wall portion thereby forming an annular chamber having a lower end opening. In a second embodiment, the chambers may be exchangedly positioned so that the second chamber is defined by an inner tubular portion and a top wall portion joined to an upper edge of the inner portion and the first chamber is defined by an outer tubular wall portion spaced from the inner tubular wall portion thereby forming an annular chamber having an upper end opening.

The releasable closing member may optionally contain threads adapted for releasable mating engagement with the second chamber. Likewise, the second chamber can also contain threads adapted for releasable mating engagement with the releasable closing member.

The beverage retainer may also include a lid adapted to contain a liquid within the first chamber. The lid may be adapted to contain a liquid within the first chamber and may optionally be of insulated construction. Still further, the lid may be dome shaped. In the preferred embodiment, the lid contains an aperture through which fluid is withdrawn for drinking. More specifically, the aperture is adapted for accommodating the positioning of a straw therein.

This invention further includes a method for chilling a beverage by placing a beverage into a first chamber of a beverage retainer, placing a chilling material into a second chamber which is positioned proximate to the first chamber, the first and second chambers being configured for thermal conductivity there between, and fitting a releasable closing member to the second chamber thereby containing the chilling material within the second chamber. This method for chilling a beverage can include the step of fitting a releasable closing member to the second chamber by threadably engaging the releasable closing member to the second chamber.

The beneficial effects described above apply generally to the exemplar devices and the mechanisms disclosed herein of the beverage retainer. The specific structures through which these benefits are delivered will be described in detail herein below.

BRIEF DESCRIPTION OF THE DRAWINGS

The invention will now be described in greater detail in the following way of example only and with reference to the attached drawings, in which.

MODE(S) FOR CARRYING OUT THE INVENTION

Figure 1:
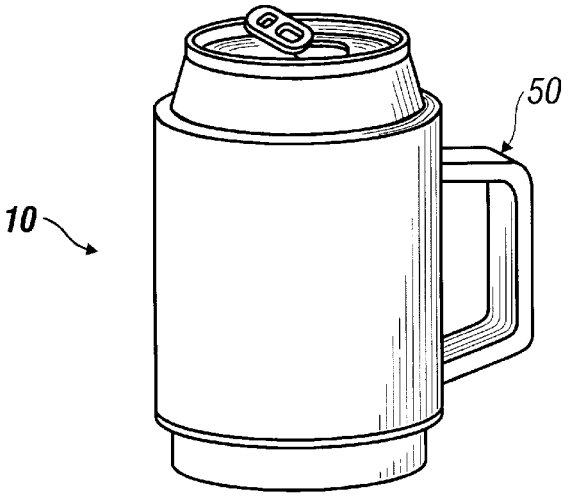
FIG. 1 is a perspective view of one embodiment of a beverage container constructed according to the present invention.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Furthermore, elements may be recited as being "coupled"; this terminology's use contemplates elements being connected together in such a way that there may be other components interstitially located between the specified elements, and that the elements so specified may be connected in fixed or movable relation one to the other.

Referring to the figures, a beverage chiller and holder (10) is shown having an open top reservoir (20), an annular ice chamber (30), a threaded base (40) and a handle (50).

The handle (50) is fitted to an outside wall of the annular ice chamber (30) and provides a convenient means for the drinker to grasp the beverage chiller and holder (10).

The annular ice chamber (30) surrounds and interfaces with the bottom and sides of the open top reservoir (20) to maximize the conduction of heat from the beverage to the ice chamber (30).

The open top reservoir (20) is sufficiently deep and wide to accept and hold a standard beverage can.

When the ice chamber (30) requires filling or emptying, the threaded base (40) is temporarily removed providing access to the chamber (30).

Figure 3:
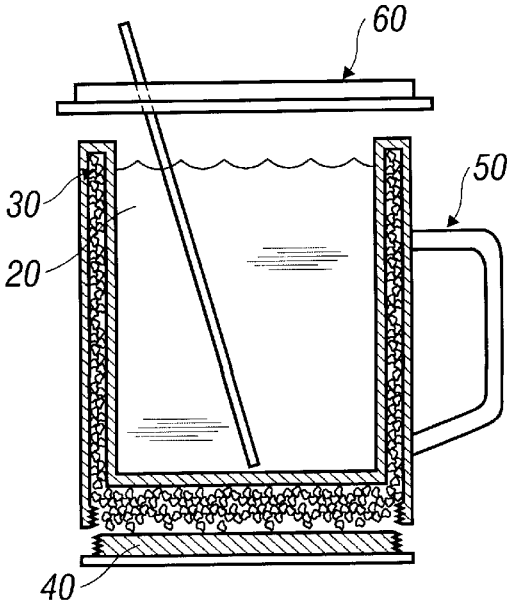
FIG. 3 is a partially disassembled view of an alternative embodiment of the present invention.

An alternative embodiment of the beverage chiller and holder (10) is illustrated in FIG. 3. In that configuration, an optional lid (60) is provided for preventing liquids from splashing from the open top reservoir (20). Further, the lid may be optionally provided with an aperture facilitating the insertion of a straw into the open top reservoir (20).

Figure 2:
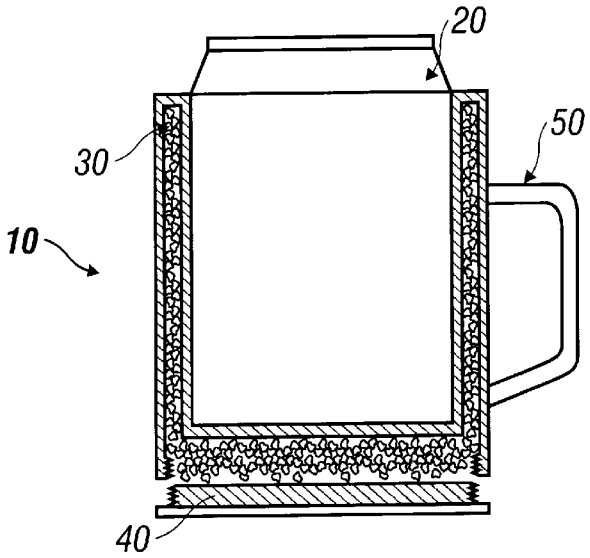
FIG. 2 is a partial cross-sectional, elevational view of the invention as shown in FIG. 1 showing the releasable closing member in a disengaged position.
Figure 4:
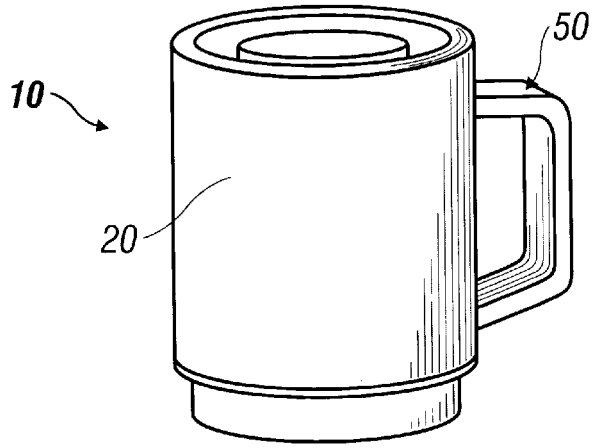
FIG. 4 is a perspective view of an alternative configuration wherein a chilling chamber is located concentrically within the interior of the beverage chamber.

FIG. 4 illustrates still a further alternative embodiment of the beverage chiller and holder (10) wherein a centralized ice chamber is provided substantially concentrically within an interior space of the open top reservoir (20). In this manner, the beverage is chilled from an interior region, as opposed to an exterior region as exhibited in FIGS. 1–3.

Figure 5:
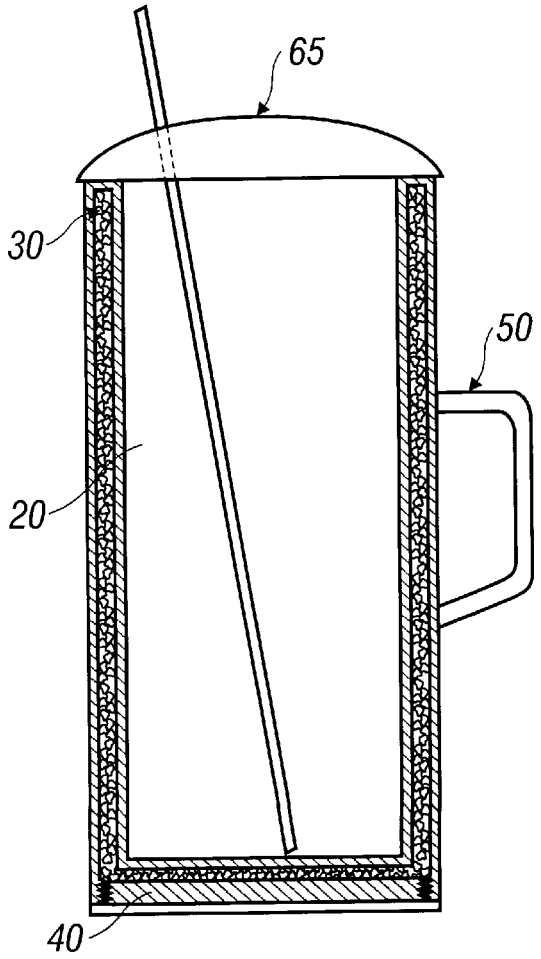
FIG. 5 is an elevational view showing the inclusion of an optional dome shaped lid.

FIG. 5 illustrates still a further alternative embodiment of the beverage chiller (10) wherein the optionally provided lid is dome shaped (65).

A beverage chiller and holder and its several components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

INDUSTRIAL APPLICABILITY:

The present invention finds applicability in the food service industries, and particularly beverage sales and dispensing industries.

What is claimed and desired to be secured by Letters Patent is as follows:

1. A beverage retainer comprising:

two chambers wherein a first chamber is fluidly separate from a second chamber and said first chamber and said second chamber are positioned proximate one another for thermal conductivity there between;

a releasable closing member adapted to contain a chilling material within said second chamber; and an insulated lid adapted to contain a liquid within said first chamber.

2. The beverage retainer as recited in claim 1; further comprising:

a handle projecting outward from an outermost wall of said two chambers.

3. The beverage retainer as cited in claim 1; wherein said first chamber is defined by an inner tubular portion and a bottom wall portion joined to a lower edge of said inner wall portion.

4. The beverage retainer as cited in claim 1: wherein said second chamber is defined by an outer tubular wall portion spaced from said inner tubular wall portion thereby forming an annular chamber having a lower end opening.

5. The beverage retainer as cited in claim 1; wherein said first chamber is defined by an outer tubular wall portion spaced from said inner tubular wall portion thereby forming an annular chamber having an upper end opening.

6. The beverage retainer as cited in claim 1; wherein said releasable closing member further comprises:

threads adapted for releasable mating engagement with said second chamber.

7. The beverage retainer as cited in claim 1; wherein said second chamber further comprises:

threads adapted for releasable mating engagement with said releasable closing member.

8. The beverage retainer as cited in claim 1; further comprising:

a lid adapted to contain a liquid within said first chamber.

9. The beverage retainer as cited in claim 1; further comprising:

a dome shaped lid adapted to contain a liquid within said first chamber.

10. The beverage retainer as cited in claim 9 wherein said lid contains an aperture adapted for accommodating of a straw positioned therein.

11. The beverage retainer as cited in claim 9 wherein said lid contains an aperture through which fluid is withdrawn from the reservoir.

12. A beverage retainer comprising:

two chambers wherein a first chamber is fluidly separate from a second chamber and said first chamber and said second chamber are positioned proximate one another for thermal conductivity there between;

said second chamber is defined by an inner tubular portion and a top wall portion joined to an upper edge of said inner portion; and a releasable closing member adapted to contain a chilling material within said second chamber.

13. A method for chilling a beverage comprising:

placing a beverage into a first chamber of a beverage retainer;

placing a chilling material into a second chamber which is positioned proximate to said first chamber, said first and second chambers configured for thermal conductivity there between; and fitting a releasable closing member to said second chamber thereby containing said chilling material within said second chamber.

14. The method for chilling a beverage recited in claim 13 wherein said step of fitting a releasable closing member to said second chamber further comprises:

threadably engaging said releasable closing member to said second chamber.

15. A method for chilling a beverage comprising:

providing a beverage retainer having a first chamber and a second chamber which is positioned proximate to said first chamber, said first and second chambers configured for thermal conductivity there between;

placing a chilling material into a second chamber;

fitting a releasable closing member to said second chamber thereby containing said chilling material within said second chamber; and placing a beverage into said first chamber of said beverage retainer.

* * * * *